United States Patent [19]

Shugart, Jr.

[11] 4,221,449

[45] Sep. 9, 1980

[54] LOCKING DEVICE FOR ELECTRIC CORDS

[76] Inventor: James F. Shugart, Jr., 907 Cambridge Rd., Redwood City, Calif. 94061

[21] Appl. No.: 36,329

[22] Filed: May 7, 1979

[51] Int. Cl.[3] ..... H01R 13/58

[52] U.S. Cl. ..... 339/75 P; 339/103 R

[58] Field of Search ..... 339/75 P, 103

[56] References Cited

U.S. PATENT DOCUMENTS

| | | | |
|---|---|---|---|
| 2,406,567 | 8/1946 | Schueneman | 339/75 P |
| 2,761,109 | 8/1956 | Hacker | 339/75 P |
| 3,183,470 | 5/1965 | Hale | 339/82 |
| 3,383,639 | 5/1968 | Anderson et al. | 339/75 P |
| 3,475,716 | 10/1969 | Laig | 339/75 P |
| 3,609,638 | 9/1971 | Darrey | 339/75 P |
| 3,999,828 | 12/1976 | Howell | 339/75 P |
| 4,145,105 | 3/1979 | Dobson | 339/75 P |

FOREIGN PATENT DOCUMENTS

| | | | |
|---|---|---|---|
| 818717 | 7/1969 | Canada | 339/75 P |

*Primary Examiner*—John McQuade

*Attorney, Agent, or Firm*—T. R. Zegree

[57] ABSTRACT

A locking device for maintaining two electrical cords in firm contact with each other comprises a longitudinal bar, a portion of its surface being serrated, a fixed end member secured to one end of the bar and an adjustable moving locking member slidably mounted on the bar adjacent the other end thereof. A plug and a socket connected thereto are positioned between the two members with the locking member being adapted to form a binding engagement with the serrated portion of the bar thereby preventing the two cords from being separated.

9 Claims, 6 Drawing Figures

LOCKING DEVICE FOR ELECTRIC CORDS

BACKGROUND OF THE INVENTION

This invention relates to an improved locking device adapted to maintain two electric cords in contact. More particularly, the invention relates to electric cord locking means designed to prevent inadvertent separation of a plug of an electric cord connected to a socket of an extension cord thus assuring continuous electric connection between the two conductor cords.

With considerable expansion in the use of power tools or movable house appliances the user frequently faces a situation where the electric cord originally connected to a power tool or appliance is not sufficiently long for the tool to reach a desired point of use thus necessitating its connection to a conventional extension cord so that the motor-driven device could be operated at a substantial distance from the nearest electric outlet. However, in cases where it is necessary to move the power tool or appliance during the use thereof, the pull exerted on the joined cords often causes the male plug and the female socket to separate thus interrupting the power supply to the tool or appliance which is annoying to the operator and time consuming for connecting the two electrical cords again.

Various types of locking devices for securing electric cords and extension cords together have been described in the patent literature. For example, U.S. Pat. No. 3,999,828 describes a non-adjustable cord connector having two ends of configuration connected by straps and a wedge which is molded with the body of the connector and connected by a strap to one end thereof. U.S. Pat. No. 3,609,638 covers an extension cord clamp assembly which is formed of a grooved rod and a pair of spring-biased clamps mounted thereon. U.S. Pat. No. 3,475,716 shows a retainer consisting of a flexible strap, one end of which has an opening for passage of one connector and the other end is provided with a fastener formed of a flexible band having a closure to keep the other conductor in place after it has been connected to the first conductor. U.S. Pat. No. 3,183,470 discloses a locking device for two electric cords which maintains them in contact by means of a pair of U-shaped locking members. The device is provided with a padlock which may be opened only by authorized personnel having a key therefor. While these prior patents disclose the concept of an electric cord locking device having different forms of clamping elements, the device of this invention provides a new approach to the structure of locking devices which has certain advantages over the prior devices.

In view of the foregoing, it is the main object of this invention to provide an improved locking device which will maintain by positive action two electric cords connected together when subjected to a pulling force exerted thereon.

Another object of this invention is to provide a simple locking device which can readily and safely be installed by the user to prevent accidental separation of two electric cords without necessitating the use of any tools for installation thereof.

A further object of this invention is to provide a removable locking device for electric cords which can easily be manufactured at a low cost from commercially available materials.

BRIEF SUMMARY OF THE INVENTION

These and other objects of the present invention will become more fully apparent from the following description taken in conjunction with the accompanying drawing.

In accordance with the invention, there is provided a locking device for two electric cords, such as a cord connected to a portable power tool, a movable home appliance or the like and an extension cord, the two cords being joined together by a standard plug and a socket. The locking device comprises a flat, relatively thin, elongated bar having transverse serrations on a portion of at least one surface thereof, an integral fixed end member at one end thereof forming a unitary structure therewith and a movable, adjustable locking member slidably mounted on the bar adjacent the opposite free end thereof. The locking member is adapted to provide a locking engagement with the serrated surface of the bar by means of a transverse slot in the lower portion of the locking member forming a passageway for the free end of the bar. The locking member is adapted to engage a notch of a serration, as will be explained hereinafter. The fixed end member and the movable locking member are provided each with a substantially aligned opening in the mid-portion thereof to receive an electric cord, both members being adapted to cooperate so that the plug and the socket are firmly connected together in a fixed position. The transverse slot in the locking member is inclined inwardly in the direction of the free end of the bar at an acute angle between about 5 and 15 degrees with respect to the horizontally positioned surface of the bar. Thus when the leading edge of the slot engages a notch of one of the serrations in the surface of the bar, a locking engagement therebetween is attained thereby preventing an inadvertent or accidental separation of the plug and the socket, both being positioned between the fixed end member and the adjustable locking member.

BRIEF DESCRIPTION OF THE DRAWING

The invention will now be more fully described with reference to the accompanying drawing wherein.

DETAILED DESCRIPTION OF THE INVENTION

Figure 1:
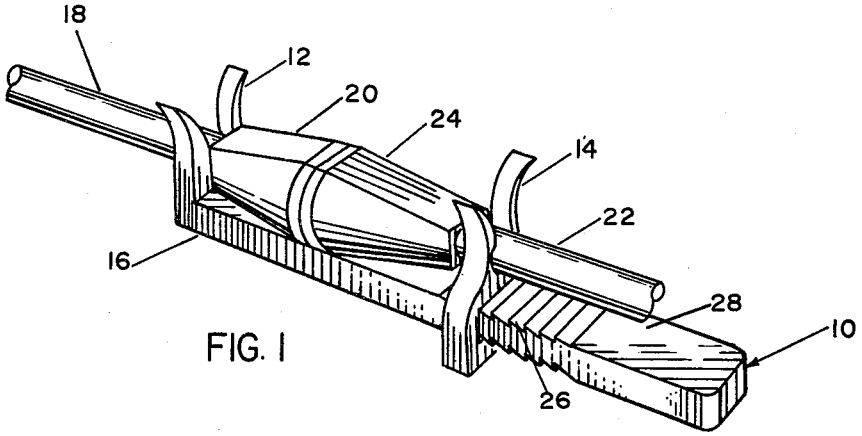
FIG. 1 is a perspective view of the locking device of this invention installed in operative position on two connected electric cords which are broken away.

Referring now to the drawing, wherein similar reference characters designate corresponding elements, a locking device 10 is illustrated in FIG. 1 with its fixed end member 12 projecting upwardly at one end of a flat, elongated, substantially rigid but slightly flexible bar 16 and a movable locking member 14 slidably mounted adjacent the opposite free end of bar 16. An electric cord 18 connected to a power tool or the like terminating with a standard plug 20 is joined to an extension cord 22 having a socket 24 into which the conventional prongs (not shown) of the plug 20 are inserted thus providing an electrical contact between the two cords.

Figure 2:
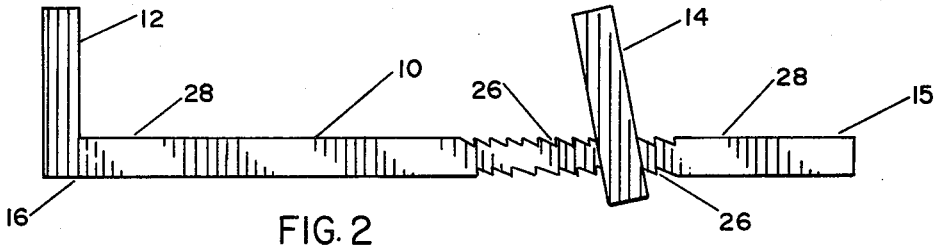
FIG. 2 is a side elevational view of the locking device itself.
Figure 3:
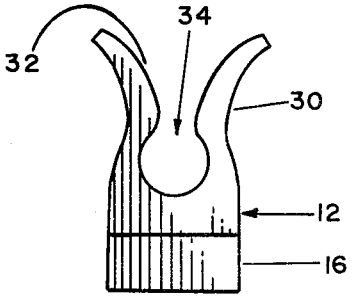
FIG. 3 is an end elevational view of the fixed end member joined to the bar.

As shown in FIGS. 1 and 2, a portion of the top and bottom surfaces of bar 16 is serrated transversely. The serrations 26 extend over a portion of bar 16 adapted to provide a gripping contact with locking member 14. The remaining portion of the top and bottom surfaces of bar 16 may be smooth inasmuch as no binding engagement with the locking member 14 is required in that portions of bar 16. Optionally, only one surface of bar 16, preferably the top surface, may be serrated providing a somewhat lesser but still satisfactory gripping contact between the locking member 14 and bar 16. The upright member 12, as illustrated in more detail in FIG. 3, is firmly secured at its base to bar 16 at one end thereof. The end member 12 extends perpendicularly to bar 16 and forms an integral unit therewith. The upper portion of end member 12 is shaped into flared, bifurcated rigid but somewhat resilient shoulders 30, the curved inner walls 32 of which form a spacing distance providing a spring-like entry for electric cord 18 into opening 34. The spring-like action of the cooperative inner walls 32 of shoulders 30 is obtained by having the distance between inner walls 32 slightly smaller than the diameter of the insulated electric cord 18 to be inserted, such distance being nevertheless sufficient for a snappy passage of cord 18 by pushing it by hand therethrough into opening 34. The inner walls 32 are curved in downward direction first inwardly then outwardly in the mid-portion of the end member 12 thus forming an enlarged opening 34 adapted to accomodate snugly a standard size insulated electric cord 18 therein. For example, a ¼ of an inch diameter opening is usually suitable for a two-wire insulated cords, while a 5/16 of an inch diameter opening is satisfactory for a 3-wire cord.

Figure 4:
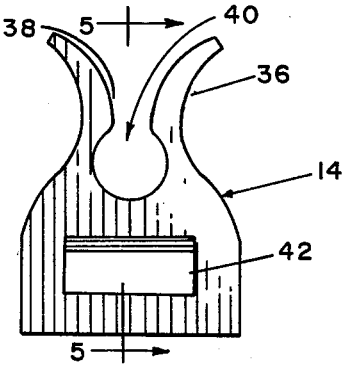
FIG. 4 is an end elevational view of the movable locking member.
Figure 5:
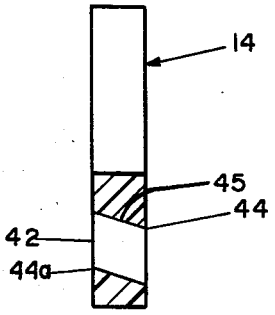
FIG. 5 is a sectional side view of the movable locking member taken as on the line 5—5 of FIG. 4 showing the inclined slot therein.

The movable locking member 14 shown in detail in FIGS. 4 and 5 has shoulders 36 with curved inner walls 38 and opening 40 of substantially the same configuration as those of end member 12. However, its lower portion includes a transverse slot 42 for slidable reception of bar 16, the slot 42 being slightly inclined inwardly in the direction of the free end member 12 at an acute angle of between about 5 and 15 degrees with respect to the top surface of horizontally disposed bar 16, preferably at an angle of between about 8 and 12 degrees.

Figure 6:
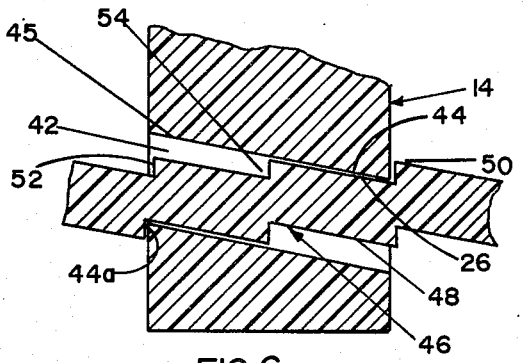
FIG. 6 is an enlarged fragmentary sectional side view of serrated top and bottom surfaces of the bar showing the edges of the movable locking member in engagement therewith.

As illustrated in FIG. 6, the top leading edge 44 of slot 42 extends angularly into notch 46 of serration 26 while the bottom trailing edge **44*a* engages a bottom serration. Specifically, the edge portions 44 and 44*a* are caused to be engaged tightly against the contour of notches 46 by contacting substantially their entire area, namely the inclined wall 48 and the upright wall 52 of notch 46. To provide a firm locking engagement between the edge portion 44 and one of serrations 26, the inclined wall 48 of notch 46 is disposed downwardly at an acute angle of between about 60 and 80 degrees, preferably between 65 and 75 degrees in relation to vertical plane, whle the upright wall 52 of notch 46 extends from the bottom 54 of notch 46 at a substantially right angle to horizontal plane up to the ridge 50 of serration 26. For best locking engagement, the leading edge 44 of slot 42 should follow substantially the entire area of notch 46. Suitably, the relation between the slot 42 of the locking member 14 and each serration 26 should be adjusted so that the distance between two adjacent ridges 50 of the serrations will correspond to about a half of the width of the top wall 45 of slot 42. It will be noted that the size of slot 42 should be slightly larger than the thickness of bar 16 so that the locking member 14 will slide smoothly thereon for adjusting purpose and will engage effectively the locking member 14 in the serration 26. As a practical matter, by way of an example, the serrations 26 may have a depth of between about 1/32 and ⅛ of an inch, a width of ridge 50 of about 1/64 to 1/32 of an inch and a distance between two adjacent ridges of between about ⅛ and ¼ of an inch. Preferably, the dimensions of serrations 26 should be the same on both surfaces of bar 16**.

The manner in which the locking device of this invention is employed to tightly hold joined ends of two electric cords is illustrated in FIG. 1. In order to insure a satisfactory locking action of the device, the two insulated electric cords 18 and 22 are connected by means of their respective male plug and female socket. A cord 18 connected to a power tool is inserted in the opening 34 of fixed end member 12 by exerting a slight pressure thereon by thumb so that the cord will pass between inner walls 32 of shoulders 30. The same procedure is then applied to an extension cord 22 which is accomodated in the opening 40 of movable locking member 14 mounted on bar 16. It will be noted that cord 18 is positioned so that the end portion of its plug 20 will be abutting against the wall of end member 12. The cord 22 will first be inserted in the opening 40 of locking member 14 in the same manner as applied to cord 18, then the locking member 14 will slidably be advanced in inclined position toward the socket 24 until shoulders 36 are in abutting contact therewith. The upper portion of locking member 14 is then pressed by hand in the direction of free end 15 of bar 16 so that the top leading edge 44 of slot 42 enters the notch 46 of serration 26 in the upper surface of bar 16 and locking member 14 will be forced in upright position into locking engagement with bar 16. It will be understood that when the top and the bottom surfaces of bar 16 are serrated, the bottom trailing edge **44*a* of slot 42 will engage in the same manner with a serration 26 on the bottom surface of bar 16. The shoulders 36 of locking member 14 thus will continuously press forwardly upon the end portion of socket 24 and thereby will complete the installation of locking device 10 on the two interconnected cords. It will be appreciated that the movable locking member 14 is spaced from the fixed member 12** by a longitudinally adjusted minimum distance to prevent separation of the connected plug and socket positioned therebetween. When it is desired to disconnect the two cords, the locking device may easily and rapidly be removed by hand by reversing the steps in the foregoing procedure.

The locking device of this invention can be fabricated from a nonconductive, rigid but somewhat resilient plastic material using any of the well known molding or other suitable methods. The fixed end member is secured to the bar integrally therewith while the movable locking member is constructed separately for subsequent mounting on the bar. Although various plastic materials having the above-mentioned characteristics including a limited stretchability are suitable, an impact-resistant and weather-resistant polycarbonate material has been found particularly satisfactory.

It will be apparent from the foregoing description that I have devised an improved adjustable device which is useful for positive locking of electric cords, said device being characterized by a combination of new features which are required for its basic function. My invention has provided an easily and rapidly mountable means for maintaining two electric cords joined together in a locked position thereby preventing them from being separated due to a pull or tension exerted thereon in the course of using any of the power tools, such as drills, saws or sanders, garden tools, such as electric law mowers, hedge trimmers or edgers, and household movable appliances, such vacuum cleaners or floor polishers, etc. which necessitate a connection with an extension cord. When an extension cord connected securely to a cord of a power tool or the like by means of the locking device of this invention is normally pulled along the floor in a shop or on the ground outdoors, the device will not snag or otherwise impede the movement of the cord. On the other hand, a sudden strong and jerky pull on the cord of a power tool may cause disengagement of the locking member from a serration thus preventing possible damage or breakage of the cord.

It will be understood that various modifications in the form of this invention as herein described in its preferred embodiment may be made without departing from the spirit or the scope of the claims which follow.

I claim:

1. A locking device for two electric cords joined by a plug and a socket comprising a flat, elongated bar having transverse serrations on a portion of at least one surface thereof, an integral fixed end member at one end of said bar, a movable locking member slidably mounted adjacent the opposite free end of said bar and being adapted to provide a locking engagement with one of said serrations, said locking member comprising a transverse slot in the lower portion thereof forming a passageway for the free end of said bar, said transverse slot being slightly inclined inwardly in the direction of said free end of said bar, said fixed member and said locking member having substantially aligned openings in the mid-portion thereof adapted to receive the electric cords, said locking member cooperating with said end member to hold said plug and said socket connected together in a fixed position.

2. The locking device of claim 1 wherein said transverse slot is inclined at an acute angle of between about 5 and 15 degrees with respect to top surface of said bar.

3. The locking device of claim 1 wherein said transverse slot is inclined at an acute angle of between about 8 and 12 degrees with respect to top surface of said bar.

4. The locking device of claim 1 wherein said bar is provided with transverse serrations on its top and bottom surfaces.

5. The locking device of claim 4 wherein the upper portion of said end member and of said locking member is formed into flared, bifurcated shoulders providing a spring-like entry for the electric cord into said opening.

6. The locking device of claim 5 wherein the shoulders in said end member and in said locking member are spaced by a distance smaller than the diameter of the electric cord but sufficient for a snappy passage of the electric cord therethrough into said opening.

7. The locking device of claim 4 wherein said movable locking member is spaced from said fixed end member by an adjusted distance required to prevent separation of the connected plug and the socket positioned therebetween.

8. The locking device of claim 4 wherein each of said serrations in the surface of said bar comprises a notch having a wall inclined downwardly at an angle of between about 60 and 80 degrees in relation to vertical plane and an upright wall extending from the bottom of said notch to the ridge thereof.

9. The locking device of claim 4 wherein the distance between two adjacent ridges of said serrations corresponds to about a half of the width of the slot in said locking member.

* * * * *